United States Patent [19]

Hansen et al.

[11] Patent Number: 5,011,577

[45] Date of Patent: Apr. 30, 1991

[54] PRESSURE CONTROL FORMING SECTION

[75] Inventors: Victor E. Hansen, Jacksonville, Fla.; David T. Smith, Monson; Douglas R. McPherson, East Longmeadow, both of Mass.; Richard E. Pitt, Carleton Place, Canada

[73] Assignee: JWI Ltd., Kanata, Canada

[21] Appl. No.: 362,938

[22] Filed: Jun. 8, 1989

[51] Int. Cl.[5] ..... D21F 1/48; D21F 9/02

[52] U.S. Cl. ..... 162/352; 162/209; 162/211; 162/364

[58] Field of Search ..... 162/208, 209, 211, 352, 162/354, 348, 351, 364

[56] References Cited

U.S. PATENT DOCUMENTS

| | | | |
|---|---|---|---|
| 2,881,676 | 4/1959 | Thomas | 162/363 |
| 2,928,466 | 3/1960 | Burkhard et al. | 162/354 |
| 2,991,218 | 7/1961 | McCirrito et al. | 162/370 |
| 2,995,186 | 8/1961 | Montigny | 162/297 |
| 3,052,296 | 9/1962 | Justus | 162/362 |
| 3,066,068 | 11/1962 | Calehuff et al. | 162/208 |
| 3,149,026 | 9/1964 | Hornbostel | 162/208 |
| 3,311,533 | 3/1967 | Montigny et al. | 162/203 |
| 3,438,854 | 4/1969 | Means | 162/354 |
| 3,874,998 | 4/1975 | Johnson | 162/374 |
| 3,981,768 | 7/1976 | Lehtinen | 162/199 |
| 4,140,573 | 2/1979 | Johnson | 162/352 |
| 4,154,645 | 5/1979 | Kankaanpaa | 162/733 |
| 4,235,667 | 11/1980 | Bergstrom et al. | 162/203 |
| 4,306,934 | 12/1987 | Seppanen | 162/209 |
| 4,734,164 | 3/1988 | Irwin et al. | 162/348 |
| 4,802,954 | 2/1989 | Malashenko | 162/348 |

FOREIGN PATENT DOCUMENTS 687466 3/1967 Belgium .

OTHER PUBLICATIONS

The Formation and Structure of Paper; Technical Section of the British Paper and Board Makers' Association (Inc.), Plough Place, Fetter Lane, London, E.C.4, 1962, vol. 2, P. E. Wrist.

*Primary Examiner*—Karen M. Hastings

*Attorney, Agent, or Firm*—Oblon, Spivak, McClelland, Maier & Neustadt

[57] ABSTRACT

A method and apparatus are disclosed whereby the rate of drainage of the stock on a Fourdrinier paper making machine can be controlled for the full length of an open surface forming section. A continuous sealed drainage box is used from adjacent the head box slice to the end of the forming section, within which the air pressure can be controlled. In the area adjacent the head box slice drainage is hindered by the use of a positive (above ambient atmospheric) pressure, whilst further along the forming section the pressure is decreased to a negative value (below ambient atmospheric). Improved paper formation and first pass retention are obtained.

28 Claims, 7 Drawing Sheets

PRESSURE CONTROL FORMING SECTION

This invention is concerned with Fourdrinier paper making machines of the type having a "flat wire" or "open wire" forming section, which includes means to remove water from the stock by the use of suction.

In this type of machines, as opposed to "twin wire" machines, or "gap formers", an aqueous slurry known as the stock, which contains both fibers and other substances in an amount of from about 0.1% to 1.5% by weight, is fed from a head box slice onto a single moving forming fabric. Water is progressively removed from the stock through the forming fabric in what is known as the "forming section" of the paper making machines. In this forming section, a variety of drainage devices are used, until the stock contains from about 2% to about 4% by weight of solid material. At that point, the distribution and orientation of the fibers and other solids in the still very wet stock is largely determined, and will not change very much in the remaining paper forming steps unless other devices such as a dandy roll, or "top wire", is brought into contact with the stock. Thus at this point the formation of the paper is largely completed.

In outline, a conventional open wire forming section includes a forming fabric which is supported at the head box slice end by a breast roll, which is followed in sequence by a "forming board" and a series of drainage devices, which may be drainage foils or table rolls, and suction boxes. More recently, forming sections have included a forming board followed by suction boxes of the type, described by Johnson, in U.S. Pat. No. 4,140,573. These suction boxes heretofore have been distributed along the length of the forming section with gaps, or undrained spaces, in between them.

The one reported attempt to use vacuum assisted drainage for the full length of an open wire forming section appears to have been a failure. Such a paper making machine is described by E.J. Justus in U.S. Pat. No. 3,052,296 (issued in 1962, assigned to Beloit Iron Works). As described by Justus, the forming fabric is to be supported on a "continuous or substantially uninterrupted" series of suction boxes, starting as near to the head box slice as is practicable. These suction boxes are provided with a foraminous surface to support the forming fabric, for which several designs are proposed. Justus proffers several advantages for such a machine: an increase in fiber retention on the forming fabric of up to 70%, as compared to the usual figure of less than about 50%, reduced wire marking on the paper, and "better" paper. A further point made by Justus is that his essentially flat surfaced suction boxes do not cause the phenomenon known as "kick-up" in the stock associated with the table rolls then used as the primary dewatering devices. Kick-up results from the vertical deflection of the forming fabric caused by the suction produced by the roll as described in U.S. Pat. No. 2,928,465. When kick-up occurs, what is observed is an essentially vertical movement of both the forming fabric and the stock carried on it in the vicinity of a table roll: this movement can become so violent that it will literally lift the stock off the forming fabric. Such an occurrence is not conducive to the making of good paper. In a later communication originating from Beloit Iron Works (reported by P. Wrist in "The Formation and Structure of Paper", British Paper and Board Makers Association, London, England, 1962, at pages 863, 864) it is noted that although many of the benefits proffered by the all-vacuum assisted drainage technique proposed by Justus indeed are obtained, nevertheless "the formation of the (paper) sheet deteriorated to an unacceptable level." (Communication to P. Wrist, from Beloit Iron Works). In other words it proved to be impossible to make acceptable quality paper using the modified Fourdrinier paper making machine proposed by Justus. Perhaps as a consequence of this failure, this approach to stock dewatering was not pursued further. Even Justus turned his attention to other methods (e.g. as in U.S. Pat. No. 3,102,066).

It has now been realized that the failure of the Justus attempts may be directly attributed to at least two seemingly unrelated causes. First, Justus in setting out to avoid the then known problems of heavy suction and kick-up becoming prevalent with table rolls (and which were becoming a handicap serving to limit paper making speed since as the linear speed of the forming fabric increased the suction and kick-up effects become more violent) endeavoured to eliminate all stock agitation in the forming section.

It has now been known for some time that improved paper making operations can result if some deliberate and controlled agitation is introduced into the stock on the forming fabric whilst it is still in a highly fluid state.

It has now been discovered that the precise spacing of the devices used to generate stock agitation has a very important effect on paper sheet quality. When the devices are spaced apart in a uniform manner, they act in a periodic or harmonic relationship to each other, so that later devices (that is, ones further from the head box slice) can either reinforce and add to the stock agitation produced by earlier devices, or diminish and dampen that agitation. This provides a controlled and uniform stock agitation that is both easily generated and easily controlled, to benefit the paper sheet formation.

Second, Justus recommends to use a vacuum level ranging from a low level of effectively zero in a suction box adjacent the head box slice rising to a figure of 2 inches of mercury at the 3% point, that is a value of about 70 cms of water. It has been discovered that this is also a mistake, and that with dewatering devices somewhat similar to those advocated by Justus a far lower level of vacuum is often sufficient, rising from a very low level adjacent the head box slice to a value of no more than 50 cms of water at the end of the forming section. It has been discovered that much lower levels of vacuum than those suggested by Justus can be used with great benefit in retention and wire mark provided the above mentioned agitation or kick-up can be achieved. This can be achieved by the use of the static drainage unit known as the Isoflo (Trade Mark) which is desribed by Johnson in U.S. Pat. No. 4,140,573.

Second, Justus recommends to use a vacuum level rising to a figure of 2 inches of mercury at what Justus calls "the 3% point". This is the point at which the solids content of the stock is approximately 3%, and broadly corresponds to the end of the forming section in a more conventional machine. Thus at the end of the forming section Justus is advocating a vacuum of some 70 cms of water gauge. It is now known that this is also a mistake, since with dewatering devices somewhat similar to those advocated by Justus a far lower level of vacuum is often sufficient, rising to a value of no more than 50 cms of water at the end of the forming section. The static drainage device known as an Isoflo, described by Johnson in U.S. Pat. No. 4,140,573 mentioned above, is suitable for this purpose.

Finally, Justus recommends vacuum assisted drainage in the first drainage boxes adjacent the head box slice. A low level of vacuum is recommended, the value given for the vacuum applied rising from zero in the very first box, to 5 centimeters of mercury at the end of the forming section. This is believed to be a further mistake, in that vacuum assitance will accelerate the drainage far too close to the head box slice.

It has now been discovered that if first, both a desired and a controlled level of agitation is maintained in the stock throughout the full length of the forming section, and second, the drainage velocity through the forming fabric is controlled, so that the rate of stock drainage can be made more uniform over the whole length of the forming section, improved paper formation will result. Furthermore, by carefully controlling the pressure in the drainage box below the forming fabric, the rate of stock drainage can be controlled so that if not uniform for the full length of the forming section, it is at least adjustable and can be optimised to levels that are more appropriate for the grade of paper being made.

Thus in a first broad aspect this invention provides a process for improving stock formation on a paper making machine including a moving forming fabric of which at least that portion adjacent the head box slice passes through an open surface forming section, comprising the steps of:

(i) discharging onto the moving forming fabric an aqueous paper making fiber stock;

(ii) causing the forming fabric to move over a forming section comprising a continuous drainage box provided with a foraminous top support surface for the forming fabric which also provides a hydraulic seal between the periphery of the forming fabric and the surface for the full length of the forming section;

(iii) controlling the pressure in the drainage box to a value that changes along the drainage box for the length of the forming section from an initial positive value above ambient atmospheric pressure sufficient to hinder water drainage through the forming fabric, without interfering with paper formation on the forming fabric, to a negative value of no more than 50 cms water gauge below ambient atmospheric at the end of the forming section; and (iv) causing a desired level of agitation in the stock on the forming fabric on the foraminous surface supporting the forming fabric along the length of the forming section.

Preferably the positive pressure is no more than 25 cms water gauge (above ambient atmospheric pressure).

Preferably, the drainage box comprises either a plurality of contiguously adjacent drainage boxes along the length of the forming section, each extending across the width of the forming fabric, or a single drainage box extending the full length of the forming section which is provided with a plurality of pressure-and vacuum-tight transverse divisions between each of which a separate controlled pressure can be applied.

In a second broad aspect this invention provides an apparatus for improving stock formation on a Fourdrinier paper making machine having an open surface forming section, comprising in combination:

(a) a drainage box located in the forming section adjacent the head box slice and extending continuously for the full length of the forming section;

(b) a foraminous surface on the drainage box adapted to support the forming fabric, to provide apertures through which the forming fabric drains under the influence of the pressure in the drainage box, to provide a hydraulic seal between the periphery of the forming fabric and the foraminous surface for the full length of the forming section;

(c) means to provide a controlled level of agitation within the stock on the forming fabric; and (d) a pressure control means whereby the pressure in the drainage box is controlled to a value that changes progressively along the drainage box for the length of the forming section from an initial positive value above ambient atmospheric pressure sufficient to hinder water drainage through the forming fabric, without interfering with the paper formation on the forming fabric to a negative value of no more than 50 cms water gauge below ambient atmospheric pressure at the end of the forming section.

Preferably the positive pressure is no more than 25 cms water gauge (above ambient atmospheric pressure).

Preferably, the foraminous surface includes a path through which the forming fabric moves which will provide a controlled level of agitation within the stock on the forming fabric.

Preferably, the drainage box comprises either a plurality of contiguously adjacent boxes, each of which is provided with a separately controlled pressure means, or a single box extending the full length of the forming section, which is provided with pressure- and vacuum-tight transverse divisions, the space between each of which is provided with a separately controlled pressure means.

Preferably in both of these broad aspects of the invention, the foraminous support surface on the drainage box comprises a plurality of static support elements having support faces for the forming fabric chosen to provide a desired level of agitation in the stock on the forming fabric from the head box slice to the other end of the forming section. In a more preferred embodiment, these static support elements are so placed as to utilize the harmonic nature of the agitation which they generate in the stock, thereby controlling the nature and amount of that agitation.

BRIEF DESCRIPTION OF THE DRAWINGS

The invention will now be described by way of reference to the attached figures in which:

In these Figures, relevant like parts have been given the same numbers.

In FIG. 1, the paper making machine is shown, incorporating a forming fabric 1, which moves in the direction of the arrows shown at 1A and 1B. The forming fabric moves over a breast roll 2, and various tensioning and idling rollers 3. The stock is deposited onto the forming fabric 1 from the head box shown diagrammatically at 4, through a slice 5, which extends across the forming fabric 1. Beneath the forming fabric in the dewatering zone are placed a sequence of drainage devices 6, 7, 8, 9, 10, 11 and 12, provided with white water drains 15, 16, 17, 18 and 19. The first of these drainage devices, 6, comprises a forming board, the second, 7, comprises an open foil unit, and the remainder are so-called Isoflo units (Trade Mark). Boxes 8 to 12 are also provided with a controlled vacuum, through the vacuum pipes 20, 21, 22, 23 and 24 respectively. The vacuum applied will typically range from zero to 5 cms water gauge in box 8, to no more than 50 cms water gauge in box 12; the white water drains 15, 16, 17, 18 and 19 contain suitable vacuum legs. A key feature, from the aspect of this invention, is that not all of the forming section is being actively drained. The drainage and suction boxes are separated by the spans marked a, b, c, d, e and f which represent undrained areas, apart from any water which may happen to drain through under gravity. In the machine shown, these spans represent nearly 30% of the total area of the forming zone. At the head box slice 5 the entire stock is delivered to the forming fabric. It then passes over the forming board 6, and foil unit 7, which serve to remove a large amount of water from the stock. Over the remaining Isoflo units 8 through 12 the balance of the freely available water is removed.

Figure 1:
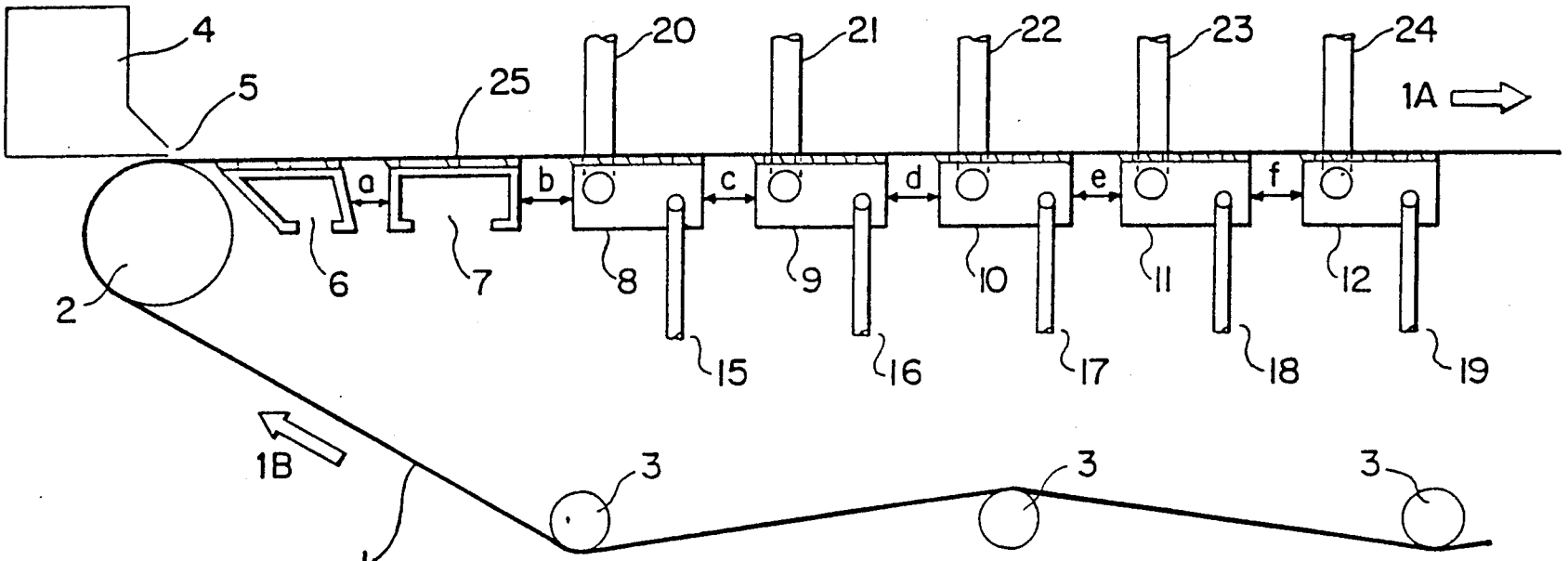
FIG. 1 PRIOR ART
FIG. 1 shows diagrammatically the initial part comprising the forming section of a Fourdrinier paper making machine.
Figure 2:
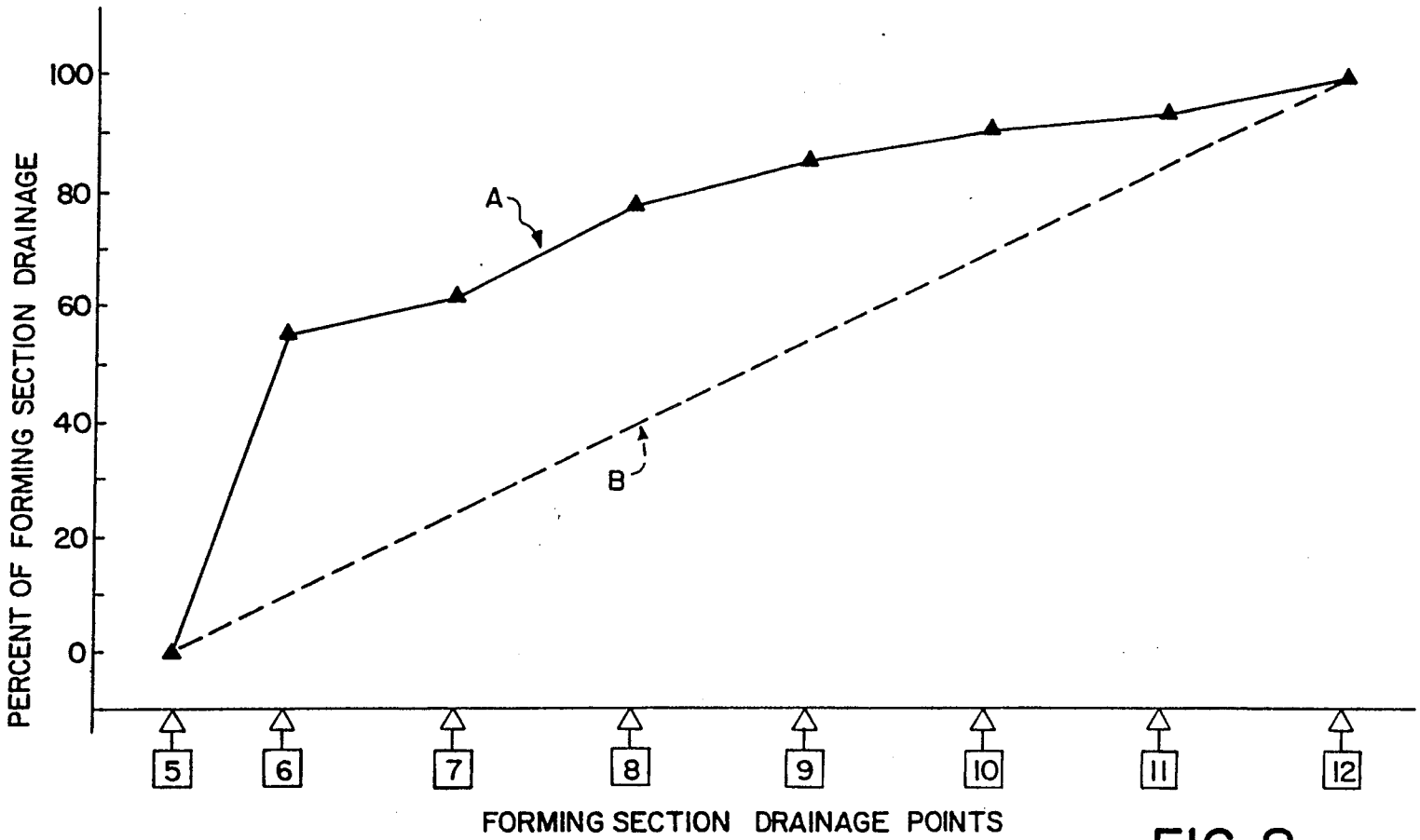
FIG. 2 shows diagrammatically a typical water drainage rate profile for the forming section shown in FIG. 1.

The rate at which water is removed from the stock in a forming section of the type shown in FIG. 1 varies widely with different paper types. A typical drainage rate is depicted schematically in FIG. 2. In this Figure, the vertical axis represents percentage water removed, based on the total removed in the forming section only. It is to be understood that at the end of the forming section the stock is still very wet, and will contain some 95% or more water. The horizontal scale corresponds roughly to the dimensions of FIG. 1. The various numbered boxes 5 through 12 correspond to the same units as in FIG. 1. The interesting feature of this graph, from the point of view of this invention, is that it indicates very clearly that the rate of water removal is far from uniform. The shape of line A indicates that the rate of drainage of the stock passing over the forming board 6 and foil unit 7 is a higher than for the remaining Isoflo units. These first two drainage elements handle some 61% of the total water removed in the forming section, even though these units occupy only some 25% of the forming section length. If the rate of water drainage were uniform, the plotted points would all fall on the dotted line B. This invention seeks to control the rate of water drainage in order to make it more uniform and at least approach line B.

In the machine of FIG. 1, which is typical of existing prior art machines, three different forms of drainage element are used, in sequence away from the head box slice 5. The first of these is a set of conventional flat forming board blades associated with an open unrestricted drainage box 6.

Figure 4A:
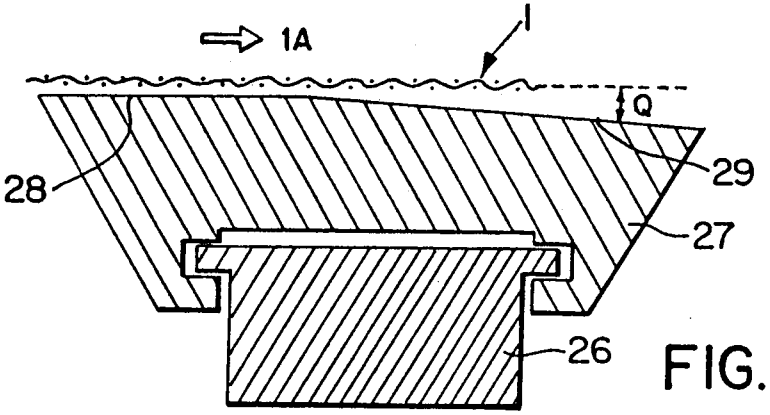
FIG. 4 shows several support blades.

The drainage elements 25, associated with the unrestricted drainage box 7, are conventional foil blades broadly conforming to the design shown in section in FIG. 4A. These foils comprise a supporting bar 26 with a tee-shaped head, onto which is slid the foil blade proper, 27. This includes a flat face 28 onto which the forming fabric 1 rests, and a divergent trailing face 29. In the Figure, the divergent angle Q is shown exaggerated for clarity. Generally it is far smaller than it is shown, ranging from about 1 degree to about 5 degrees, with angles of 2 to 2.5 degrees being commonly used. As the forming fabric moves over the foil in the direction of the arrow 1A, water is sucked from the stock through the forming fabric as a consequence of hydraulic phenomena created in the nip provided by the trailing face 29.

Figure 4B:
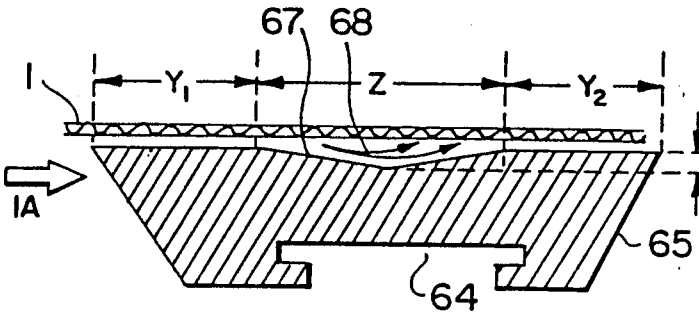
Figure 4C:
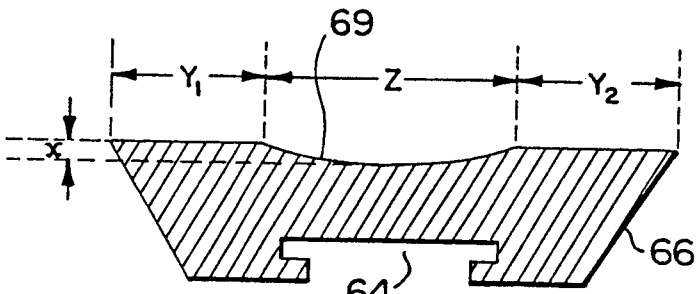
FIG. 4C PRIOR ART
Figure 5:
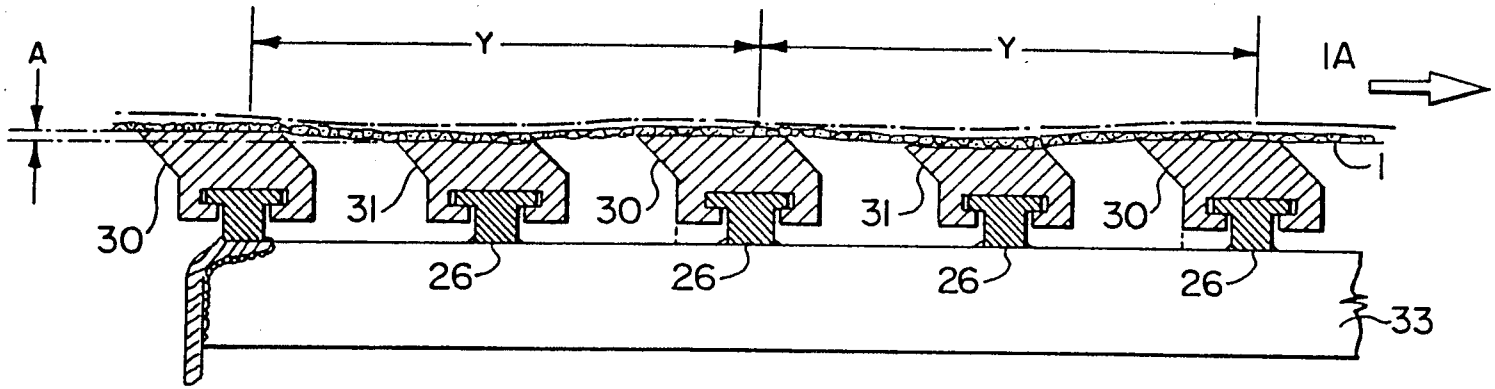
FIG. 5 PRIOR ART
FIG. 5 shows a so-called Isoflo unit.

In boxes 8 through 12 a so-called Isoflo unit is used, which is described in detail in Johnson, U.S. Pat. No. 4,140,573. This is shown in FIG. 5 (which corresponds broadly to Johnson's FIG. 4), and can be seen to incorporate two groups of static devices 30 and 31. Devices 30 and 31 are each supported on a tee-bar 26; these tee bars 26 are supported across the width of the box by suitably placed supports 33. Although similar in appearance to the foil blades of FIG. 4A, the static devices 30 and 31 differ in two separate ways. The top faces of all of these devices which bear against the forming fabric 1 are generally planar and either in the plane of the forming fabric (devices 30) or a little below it (devices 31). As shown in FIG. 5 the vertical lowering of the devices 30 is indicated at A, which is exaggerated for clarity. In practice, this distance generally will range from about 0.5 mm to about 5.0 mm. The forming fabric in moving over such a foraminous surface is drawn down by the vacuum and undulates between successive devices 30. The intervening devices 31 are so placed vertically as to provide a water seal to the underside of the forming fabric. Sealing elements, not shown, are also provided along the sides of the boxes in between the drainage devices, parallel to the sides of the forming fabric. Water is drawn from the stock through the forming fabric by the application of vacuum to the boxes 8 through 12, and leaves the boxes through drains 15 through 19, each of which also provides a suitable vacuum seal.

Figure 6:
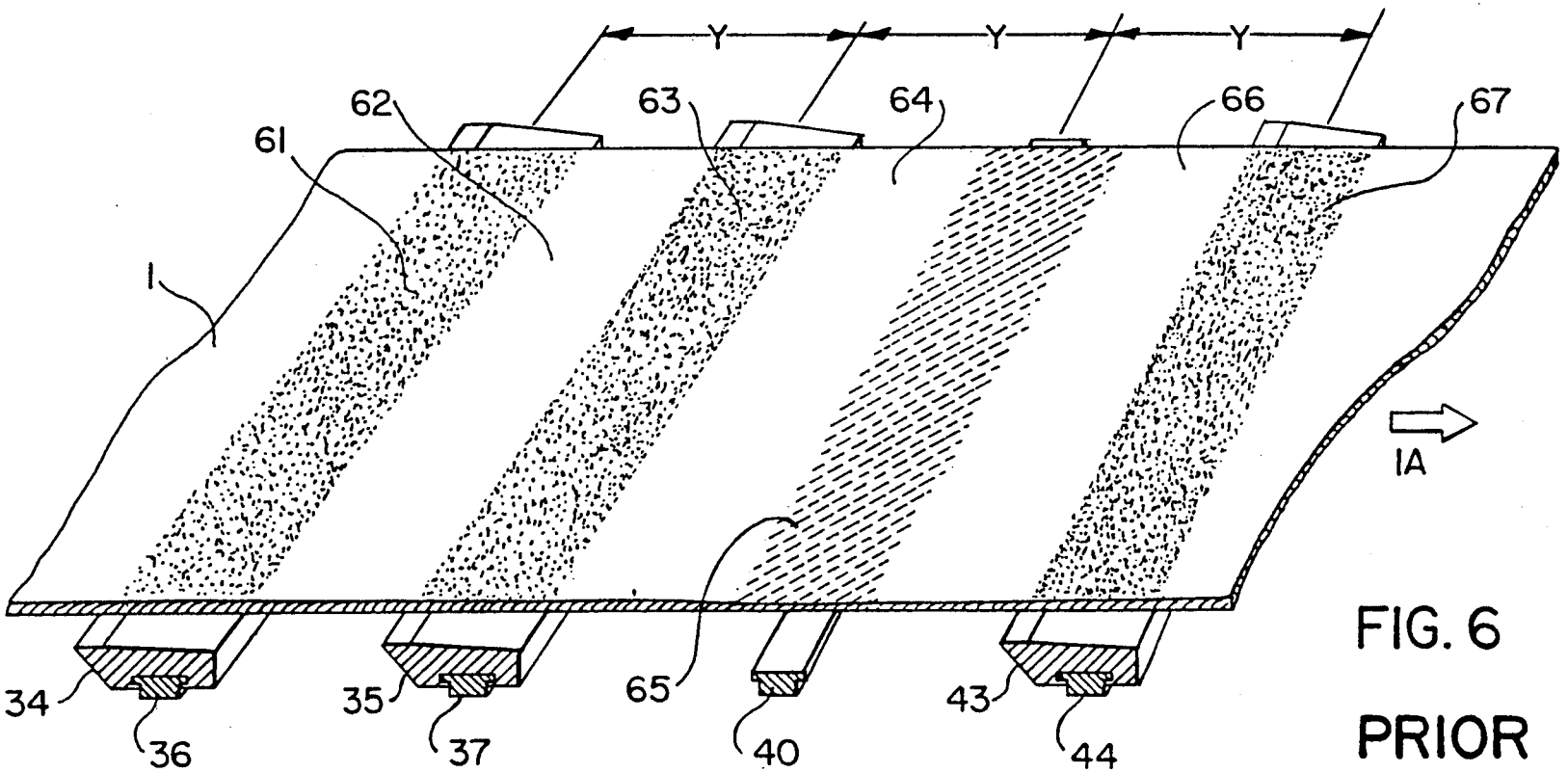
FIG. 6 PRIOR ART
FIG. 6 shows schematically harmonic stock agitation associated with a series of foils.

There is a further feature which is common to both of these forms of static drainage devices. FIG. 6 shows diagrammatically the harmonic, or periodic, stock agitation that can be generated by a regular and uniform spacing of the vertical pulses generated by foil blades supporting a forming fabric. In FIG. 6, a small section of the forming fabric 1 is shown moving in the direction of arrow 1A. The forming fabric passes over a series of foil blades all uniformly spaced apart by the distance Y, as indicated between foil blades 34 and 35 mounted on the tee bars 36 and 37. Because the stock agitation is generated by vertical movement of the forming fabric caused by the foil blades, which are each spaced apart by the constant distance Y, the area of vertical stock agitation shown by 61 is followed by another similar area 63. Similarly, the quiescent zone 62 is followed by another quiescent zone 64, following the area 63. As FIG. 6 indicates, both the areas of vertical agitation 61 and 63 and the zones of quiescence 62 and 64 are each spaced apart at the same distance Y. As shown in FIG. 6, with no foil blade on the tee bar 40, vertical agitation of the stock still occurs at the location 65, which is differently shaded in FIG. 6 to emphasize that there is no foil blade on tee bar 40, and the amplitude of the agitation at the location 41 is somewhat less than is obtained with a foil blade in place on tee bar 40. The occurrence of this activity in the vicinity of the tee bar 40 (which has no foil blade) is referred to as occurring at a "ghost blade". It is also important to note that these areas of agitation and quiescence in the stock do not move with the forming fabric, but rather remain in essentially the same place. Normal activity is restored at 67 after a further quiescent zone 66 by foil 43 mounted on T-bar 44.

For the Johnson Isoflo device shown in FIG. 5, the area of the stock vertical agitation is due to the downward deflection of the fabric as it moves from fabric support surfaces 30 to surfaces 31, and periodicity, noted again at Y, similar to that of FIG. 6 is observed.

Figure 3:
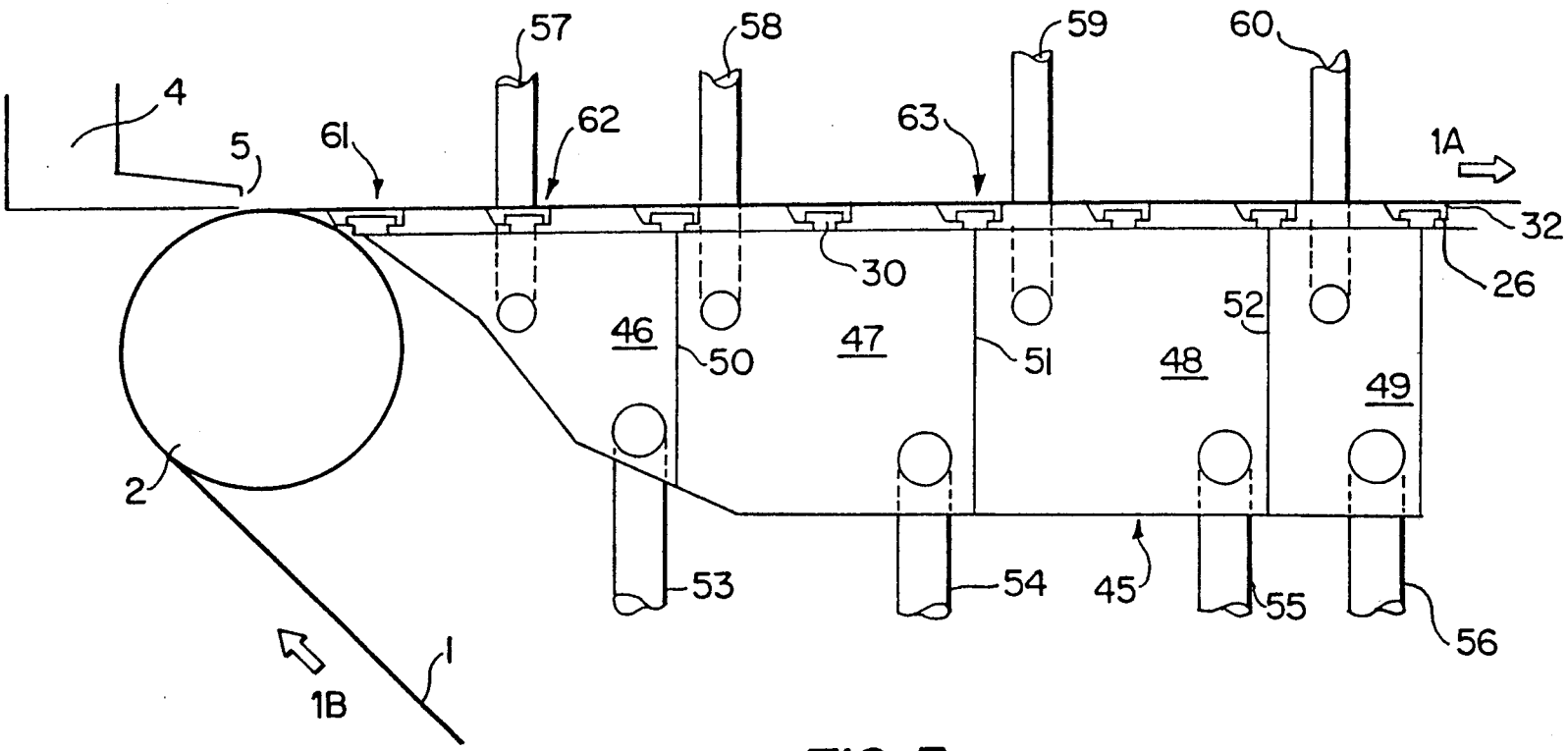
FIG. 3 shows a forming board and combined foil unit.
Figure 7:
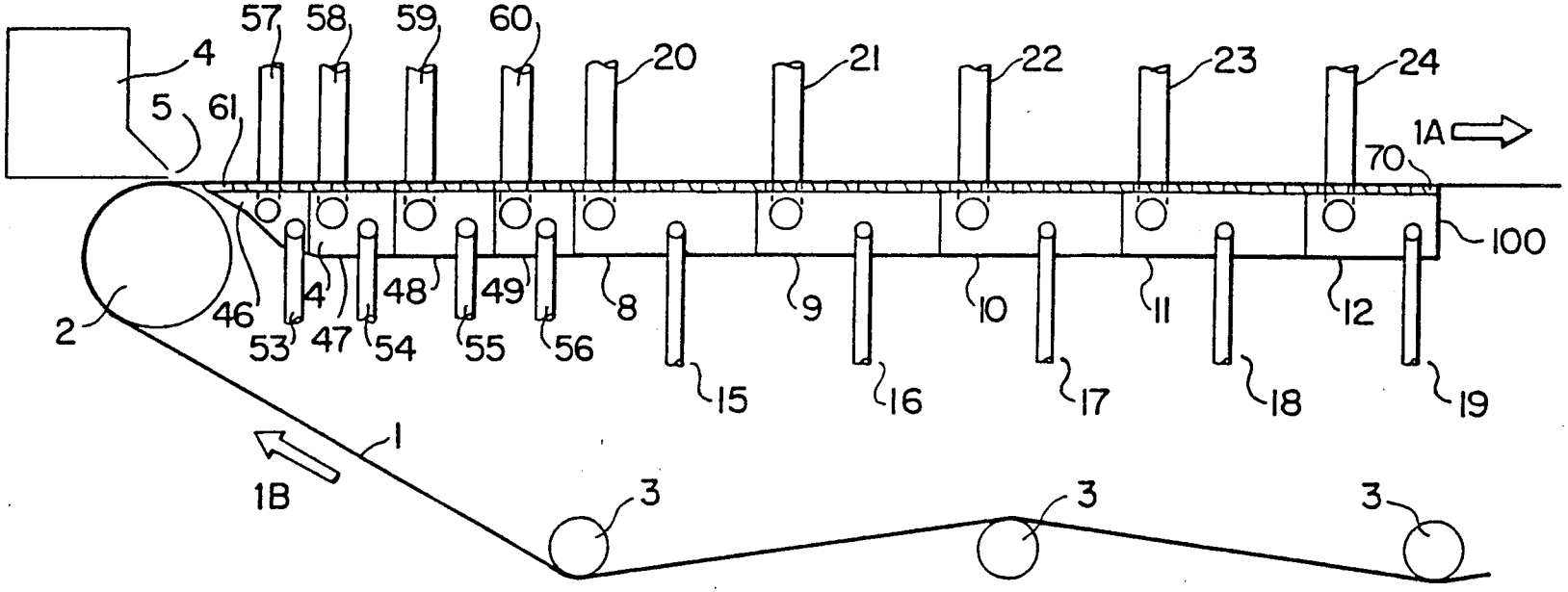
FIG. 7 shows diagrammatically the initial part of a Fourdrinier paper making machine modified according to one aspect of this invention.

In FIGS. 3, 4 and 7 are shown in detail particular embodiments of the improvements contemplated by this invention.

In the forming section shown in FIG. 1 there are two gaps, a and b, in the forming board and foil unit area. In the revised forming board of FIG. 3 both of these gaps are eliminated. In this unit, the forming fabric 1 still enters the forming section over the breast roll 2 and under the head box slice 5. Immediately adjacent the slice 5 are four contiguous drainage boxes 46, 47, 48 and 49. Unlike boxes 6 and 7 these are not open and free draining. Each box is sealed and provided with a drainage leg 53, 54, 55 and 56, and also is provided with air inlet pipes 57, 58, 59 and 60 which include air pressure control means (not shown). The forming board surfaces used comprise a T-bar as at 30, onto which an elongate blade is mounted, for example the blade shown at FIG. 4B, and which extend the full width of the forming fabric. Between these blades sealing elements (not shown) are placed to seal the sides of the forming fabric to the foraminous surface of the drainage box. Generally the first blade, 61, which supports the forming fabric in the region where the stock jet exiting the slice impacts onto the forming fabric 1, is wider than the remaining blades as at 62. It is now known that this need not be so, and a blade substantially the same width as the others can be used. In order to maintain pressure sealing, it is also necessary that blades be present as shown directly above the dividing walls 50, 51 and 52.

The shape of the top surfaces of these blades and their placement is of importance. It is now known that almost any surface used to support a forming fabric, even at this very early stage of paper formation, has an observable effect on the stock on the forming fabric. The characteristics of the surface can therefore be chosen to produce agitation in the stock which can range from sufficient effectively to lift the stock bodily off the forming fabric and ranging downwardly through visible macroscopic agitation to microscopic agitation which can only be observed by using careful photography and strobe illumination. Furthermore, as is already discussed above, these blades can be placed to utilize the harmonic nature of the agitation. Both of these concepts are utilized herein. The blades are placed to utilize harmonic phenomena, and to induce the required microagitation, at least as far as the blade 32. A simple narrow flat blade causes but little agitation. A foil blade, as in FIG. 4A based on the original Wrist ideas, will probably cause too much agitation for the area adjacent the head box slice. Further, since a foil blade drains the stock as a consequence of hydraulic phenomena in the nip angle Q, the rate of which it drains the stock is somewhat uncontrollable. The last blades, on box 49, could perhaps be foils. A third option is shown in FIGS. 4B and 4C, which is derived from the agitator blade described by Johnson, in U.S. Pat. No. 3,874,998. In each case, the blade 65 or 66 mounts on a T-bar by way of the slot 64. Referring first to FIG. 4B, the blade 65 has a central depression 67 in its top surface, so that a cross-machine gap of a flat triangular shape is created below the plane of the forming fabric. Alternatively, as shown in FIG. 4C, this depression rather than being triangular, can be a shallow concave shape as at 69. In both of FIGS. 4B and 4C, as is shown in FIG. 4B, water enters this depression from the stock on the forming fabric 1, it re-enters the stock, as indicated by the arrows 68 in FIG. 4B. Careful choice of each of the distances $y_1$, $y_2$ and z then controls the amount of agitation imparted to the stock. The amount of agitation that is needed at this early stage of paper formation is small, in the microagitation range mentioned earlier, and therefore it is possible that not all of the blades will have a depression, since, as is noted above, a flat-blade surface also causes some agitation. The first blade immediately following the head box slice generally is flat surfaced.

Typical dimensions for a blade such as those shown in FIG. 4B or FIG. 4C when used to cause microagitation are:

(i) total width (i.e. $y_1+y_2+Z$): 25 mm to 75 mm (ii) flat surface width: generally $y_1$ and $y_2$ are equal, but are not necessarily so; the minimum for each is about 5 mm, with a value of about 10 mm being preferred (iii) the width, z, of the depression: 15 mm to 65 mm (iv) the depth, x, of the depression: 0.25 mm to 2.5 mm, for both a triangular and a curved depression.

These dimensions are given as exemplary and do not limit the scope of this invention, as other dimensions may be found useful in particular circumstances.

The preferred value for the depression width z is that it is about half the total width of the blade. This then leaves adequate leading and trailing flat portions ($y_1$ and $y_2$) to get a water seal onto the blade in these areas. As the depth also affects the amount of agitation, a wider blade will not necessarily require a deeper depression. In many cases it is found that if the blade is widened then the depth, x, should not be changed, although the width z will generally increase, to maintain it at about half the total blade width. In selecting a blade for a given circumstance, some care is needed. The narrowest blade that gives adequate support should be used. Similarly, the shallowest depression should be used that is needed to cause the desired amount of agitation. If the blade is made too wide, and the depression is made too deep, then the level of agitation can go far beyond the microagitation needed in this area of the forming fabric to a level where the forming fabric with the stock on it lifts clear of the blades. Although it is simpler to use a blade with a single depression, it is realized that in certain circumstances a wider blade with more than one depression might be desirable. If such a blade is used, then the central flat portion between the depressions should be about as wide as the leading and trailing flat surfaces.

Turning now to FIG. 7, it can be seen that this represents the full length of the forming section of FIG. 1, but with two main changes. First, the forming board unit 6 and the foil unit 7 are replaced by the unit shown in FIG. 3. Second, the various Isoflo drainage boxes 8, 9, 10, 11 and 12 and the boxes 46, 47, 48 and 49 have been incorporated into one full-length drainage box 100. As shown this is a continuous single box the full length of the forming section. Such a lengthy unit is cumbersome and would present engineering problems (but it does permit easy placement of suitable dividing walls, for example if the paper type being made is changed). Alternatively, a sequence of contiguous boxes can be used, each provided with its own pressure and drainage pipes, and pressure control means. It is also to be noted that there is a forming fabric support placed directly over each dividing wall in the box 100. For the Isoflo units, 8, 9, 10, 11 and 12 these blades have to be an upper one, that is a blade 30 in FIG. 5.

The overall consequences of this form of construction can now be considered. In the forming section shown in FIG. 7, unlike that in FIG. 1, the machine side of the entire length of the forming section from the first support blade of the forming board 61 to the last support element 70 of the Isoflo unit 12 is hydraulically sealed and there are no free drainage gaps remaining. Further, by using the various pressure pipes 20 to 24 and 57 to 60 the pressure in each compartment of the box 100 can be separately controlled to a desired value, either above or below ambient atmospheric pressure. Finally, by careful choice of the top surface shape and placement of the support elements, the path through which the forming fabric moves can be controlled to induce a desired level of agitation in the stock. Generally this will increase from an almost invisible level of micro-agitation near the head box slice 5, to visible induced macroagitation over much of the remainder.

Due to the hydraulic seal between the forming fabric and the support surface provided by the support elements and the sealing members, the pressure in the various compartments of the box 100 can also be controlled in such a way that a far more uniform drainage rate can be obtained. If arbitrarily "zero" is taken as ambient atmospheric pressure, then a typical pressure profile would range from a positive figure of up to no more than 25 cms water gauge in box 46, to a negative figure of down to no more than 50 cms water gauge at box 12. Such a pressure profile would pass through zero, or ambient pressure, at about box 49 or box 8. By utilizing this positive applied pressure in the early boxes, the high rate of drainage normally associated with this part of the forming section can be significantly reduced, so that the overall drainage rate profile can approach the ideal of the line B in FIG. 2. Under these conditions of controlled agitation and controlled drainage rate better paper formation is obtained. Further, it appears that stock retention in the paper also improves.

Retention is fundamental in paper making. The commonly used definition in paper making for first pass retention (FPR) is $$\frac{\text{Head Box Consistency} - \text{White Water Consistency}}{\text{Head Box Consistency}} \times 100$$

Values for FPR can range from 30% in the case of papers with a high filler content to over 90% for some long fibered grades. Several factors affect the FPR including the type or stock, the kind of forming fabric, the use of chemical retention aids, the amount of stock agitation, the amount of suction used in forming the paper, and particularly the velocity induced in the stock by that suction while forming. Improving retention from 45% 59 70% reduces the consistency of the recirculating white water considerably if the amount of slice opening is left unchanged. (By "consistency" in this context is meant the total suspended solids content in percent by weight in the stock or in the white water, as appropriate). This has beneficial effects on the entire paper mill and reduces the amount of fiber and filler loss. Alternatively, the paper maker may cut down on the slice opening and use less water for form the paper. Thus one benefit of this invention, which allows using controlled drainage rates while still achieving good formation, is to reduce the velocity of drainage thereby improving retention and wire mark. An improvement in FPR of up to 20% can be obtained with a forming section according to this invention.

What is claimed is:

1. In a paper making machine having an open surface forming section, including at least a travelling continuous forming fabric which passes over a breast roll adjacent a head box having a head box slice through which aqueous stock is deposited onto the forming fabric, in which forming section the solids content rises from an initial low value as deposited from the head box through the head box slice onto the forming fabric to a value of from about 2% to about 4%, an apparatus for improving paper formation consisting essentially of in combination:

(a) a drainage means located beneath the forming fabric and which includes a first part, a second part, and a third part, and which extends from a point adjacent the head box slice to the end of the forming section;

(b) a foraminous support surface for the open surface forming fabric on the drainage means; and (c) air supply means, including both vacuum pump means, air pressure pump means, and air pressure control means, whereby the air pressure in the drainage means is controlled, wherein:

(i) the drainage means comprises either a single drainage box divided into a plurality of separate compartments by a plurality of air tight divisions extending across the width of the drainage box, each compartment of which is provided with a separate air supply means and a separate air pressure tight drainage means, or a plurality of contiguously adjacent drainage boxes which in effect forms a plurality of separate compartments, each of which extends across the width of the forming fabric, and each of which is provided with a separate air supply means and a separate air pressure tight drainage means;

(ii) the air supply means is structured and arranged to provide an air pressure in the compartments which decreases from a positive value above ambient atmospheric in the first part adjacent the headbox slice sufficient to hinder water drainage from the stock through the forming fabric but insufficient to interfere with paper formation on the forming fabric, to ambient atmospheric pressure in the second part and to a negative value of no more than 50 cms water gauge below ambient atmospheric pressure in the third part at the end of the forming section;

(iii) the foraminous support surface provides apertures through which the forming fabric drains, and a path through which the forming fabric moves which will cause a controlled level of uniformly spaced periodic harmonic agitation within the stock on the forming fabric, and provides an air pressure tight seal between the compartments and the forming fabric; and (iv) the foraminous support surface over the third part of the drainage means comprises a slotted-type fabric cover comprising a series of spaced forming fabric supporting blades having a generally planar top surface transverse to the direction of travel of the forming fabric in a common essentially horizontal plane providing therebetween suction-accessible gaps in which the forming fabric is substantially unsupported and is drawn downward to form stock-agitating undulations in said gaps, said cover including water seal forming blades disposed intermediately in the gaps between the fabric supporting blades and having top surfaces transverse to the direction of travel of the forming fabric at a level lower than the top surfaces of the fabric supporting blades and at least forming water seals at the downward undulations of the forming fabric, thereby interrupting the suction temporarily to limit drainage while causing vertical agitation of fibers on the fabric passing through the forming section; wherein both the first, the last, and any intermediate blades placed over either an internal vacuum tight division or a pair of contiguous transverse walls of two adjacent drainage boxes are all forming fabric-supporting blades; and wherein sealing strips are interposed between the ends of the blades adjacent the lateral edges of the forming fabric;

(v) the foraminous support surface over the first and the second parts adjacent the head box slice includes a plurality of static support elements uniformly spaced so as to generate uniform periodic harmonic agitation in the stock;

(vi) the static support elements comprise a plurality of thin elongate blades having top fabric supporting faces extending across the full width of the forming fabric, together with sealing strips interposed between the ends thereof adjacent the lateral edges of the forming fabric, (vii) the static support elements include at least one static support element in the first part having a top support face for the forming fabric which contributes to the desired level of periodic harmonic agitation in the stock, and which comprises a flat surface having a leading and a trailing portion in the direction of forming fabric travel separated by at least one shallow depression extending along the blade for the width of the forming fabric and wherein each of the leading and trailing portions, and of any flat portions intermediate shallow depressions, are of sufficient width in the direction of forming fabric travel to provide a hydraulic seal to the forming fabric; and (viii) one of the plurality of thin elongate blades is placed both above either an internal transverse division in the drainage box or a pair of contiguous walls of adjacent drainage boxes and above the first wall of the first part of the drainage means.

2. An apparatus according to claim 1 wherein the static support elements over the second part includes at least one foil consisting of a flat support surface and a trailing portion in the direction of forming fabric travel diverging from the plane of the fabric at an angle greater than zero degrees and less than 5 degrees.

3. An apparatus according to claim 2 wherein the trailing portion diverges from the plane of the fabric at an angle of from about 2 degrees to about 2.5 degrees.

4. An apparatus according to claim 1 wherein a foil is placed substantially over any intermediate internal air tight division in the second part of the drainage box; wherein the first support blade of that part of the foraminous support surface over the second part of the drainage box is substantially over an internal air tight division in the drainage box separating the first and the second parts of the drainage box.

5. An apparatus according to claim 1 wherein all of the static support elements are of the same width.

6. An apparatus according to claim 1 wherein the first static support element adjacent the head box slice is wider than the remainder.

7. An apparatus according to claim 1 wherein the top support face of at least one of the static support elements is a substantially flat surface.

8. An apparatus according to claim 1 wherein the top support face has only one shallow depression.

9. An apparatus according to claim 8 wherein the shallow depression extends for about one half of the width of the blade.

10. An apparatus according to claim 9 wherein each of the leading and trailing portions are about one quarter of the width of the blade.

11. An apparatus according to claim 1 wherein the static support elements over the second part include at least one static support element having a top support face which contribute to the desired level of periodic harmonic agitation in the stock.

12. An apparatus according to claim 11 wherein the static support elements over the second part of the drainage box include a plurality of static support elements having a top support face which contribute to the desired level of periodic harmonic agitation in the stock.

13. An apparatus according to claim 12 wherein the top support face has only one shallow depression.

14. An apparatus according to claim 13 wherein the shallow depression extends for about one half of the width of the blade.

15. An apparatus according to claim 14 wherein each of the leading and trailing portions are about one quarter of the width of the blade.

16. An apparatus according to claim 12 wherein all of the static support elements are of the same width.

17. An apparatus according to claim 12 wherein the top support face has only two shallow depressions, and further wherein each depression is about the same width, each of the leading, trailing and intermediate flat portions are about the same width, and each of them are about one half of the width of the depressions.

18. An apparatus according to claim 1 wherein the top support face has only two shallow depressions, and further wherein each depression is about the same width, each of the leading, trailing and intermediate flat portions are about the same width, and each of them are about one half of the width of the depressions.

19. An apparatus according to claim 18 further including at least one static support element having a substantially flat top surface.

20. In a paper making machine having an open surface forming section, including at least a travelling continuous forming fabric which passes over a breast roll adjacent a head box having a head box slice through which aqueous stock is deposited onto the forming fabric, in which forming section the solids content rises from an initial low value as deposited from the head box through the head box slice onto the forming fabric to a value of from about 2% to about 4%, an apparatus for improving paper formation consisting essentially of in combination:

(a) a drainage means located beneath the forming fabric and which includes a first part, a second part, and a third part, and which extends from a point adjacent the head box slice to the end of the forming section;

(b) a foraminous support surface for the forming fabric on the drainage means; and (c) air supply means, including both vacuum pump means, air pressure pump means, and air pressure control means, whereby the air pressure in the drainage means is controlled, wherein;

(i) the drainage means comprises either a single drainage box divided into a plurality of separate compartments by a plurality of air tight divisions extending across the width of the drainage box, each compartment of which is provided with a separate air supply means and a separate air pressure tight drainage means, or a plurality of contiguously adjacent drainage boxes which in effect forms a plurality of separate compartments, each of which extends across the width of the forming fabric, and each of which is provided with a separate air supply means and a separate air pressure tight drainage means;

(ii) the air supply means is structured and arranged to provide an air pressure in the compartments which decreases from a positive value above ambient atmospheric in the first part adjacent the headbox slice sufficient to hinder water drainage from the stock through the forming fabric but insufficient to interfere with paper formation on the forming fabric, to ambient atmospheric pressure in the second part and to a negative value of no more than 50 cms water gauge below ambient atmospheric pressure in the third part at the end of the forming section;

(iii) the foraminous support surface provides apertures through which the forming fabric drains, and a path through which the forming fabric moves which will cause a controlled level of uniformly spaced periodic harmonic agitation within the stock on the forming fabric, and provides an air pressure tight seal between the compartments and the forming fabric; and (iv) the foraminous support surface over the third part of the drainage means comprises a slotted-type fabric cover comprising a series of spaced forming fabric supporting blades having a generally planar top surface transverse to the direction of travel of the forming fabric in a common essentially horizontal plane providing therebetween suction-accessible gaps in which the forming fabric is substantially unsupported and is drawn downward to form stock-agitating undulations in said gaps, said cover including water seal forming blades disposed intermediately in the gaps between the fabric supporting blades and having top surfaces transverse to the direction of travel of the forming fabric at a level lower than the top surfaces of the fabric supporting blades and at least forming water seals at the downward undulations of the forming fabric, thereby interrupting the suction temporarily to limit drainage while causing vertical agitation of fibers on the fabric passing through the forming section; wherein both the first, the last, and any intermediate blades placed over either an internal vacuum tight division or a pair of contiguous transverse walls of two adjacent drainage boxes are all forming fabric-supporting blades; and wherein sealing strips are interposed between the ends of the blades adjacent the lateral edges of the forming fabric;

(v) the foraminous support surface over the second part comprises a plurality of foils each consisting of a flat support surface and a trailing portion in the direction of forming fabric travel diverging from the plane of the fabric at an angle greater than zero degrees and less than 5 degrees;

(vi) a foil is placed substantially over either an internal air tight division in the drainage box or a pair of contiguous walls of adjacent drainage boxes in the second part controlled to be at atmospheric pressure;

(vii) the foils are uniformly separated so as to contribute to the periodic harmonic agitation in the stock;

(viii) the first support blade of that part of the foraminous support surface over the third part is substantially over an internal air tight division in the drainage means separating the second and the third parts of the drainage means;

(ix) the foraminous support surface over the first part which is adjacent the head box slice includes a plurality of static support elements uniformly spaced so as to generate uniform periodic harmonic agitation in the stock;

(x) the static support elements comprise a plurality of thin elongate blades having top fabric supporting faces extending across the full width of the forming fabric, together with sealing strips interposed between the ends thereof adjacent the lateral edges of the forming fabric;

(xi) the static support elements include at least one static support element having a top support face for the forming fabric which contributes to the desired level of periodic harmonic agitation in the stock, and which comprises a flat surface having a leading and a trailing portion in the direction of forming fabric travel separated by at least one shallow depression extending along the blade for the width of the forming fabric and wherein each of the leading and trailing portions, and of any flat portions intermediate shallow depressions, are of sufficient width in the direction of forming fabric travel to provide a hydraulic seal to the forming fabric; and (xii) one of the plurality of thin elongate blades is placed both above either an internal transverse division in the drainage box or a pair of contiguous walls of adjacent drainage boxes and above each of the first and last walls of the first part of the drainage means.

21. An apparatus according to claim 20 wherein the trailing portions of the foils diverge from the plane of the fabric at an angle of from about 2 degrees to about 2.5 degrees.

22. An apparatus according to claim 20 wherein the static support elements are of the same width.

23. An apparatus according to claim 20 wherein the first static support element adjacent the head box slice is wider than the remainder.

24. An apparatus according to claim 20 wherein the top support face of at least one of the static support elements is a substantially flat surface.

25. An apparatus according to claim 20 wherein the top support face has only one shallow depression.

26. An apparatus according to claim 20 wherein the shallow depression extends for about one half of the width of the blade.

27. An apparatus according to claim 26 wherein each of the leading and trailing portions are about one quarter of the width of the blade.

28. An apparatus according to claim 20 wherein the top support face has only two shallow depressions, and further wherein each depression is about the same width, each of the leading, trailing and intermediate flat portions are about the same width, and each of them are about one half of the width of the depressions.

* * * * *